United States Patent [19]

Spamer

[11] Patent Number: 5,022,535

[45] Date of Patent: Jun. 11, 1991

[54] GRAVITY FEED SHELF

[75] Inventor: William S. Spamer, Roswell, Ga.

[73] Assignee: The Mead Corporation, Dayton, Ohio

[21] Appl. No.: 517,366

[22] Filed: May 1, 1990

[51] Int. Cl.[5] ..... A47F 5/00

[52] U.S. Cl. ..... 211/59.2; 211/187

[58] Field of Search ..... 211/59.2, 193, 187, 211/162, 135; 108/144, 111

[56] References Cited

U.S. PATENT DOCUMENTS

| | | | |
|---|---|---|---|
| Re. 30,706 | 8/1981 | Bustos | 211/59.2 |
| 2,730,825 | 1/1956 | Wilds | 211/59.2 X |
| 3,900,112 | 8/1975 | Azzi et al. | 211/59.2 X |
| 4,294,363 | 10/1981 | Oztekin et al. | 211/59.2 |
| 4,565,725 | 1/1986 | Spamer et al. | 211/59.2 X |

FOREIGN PATENT DOCUMENTS

| | | | |
|---|---|---|---|
| 1405351 | 5/1965 | France | 211/59.2 |

*Primary Examiner*—Carl D. Friedman
*Assistant Examiner*—Sarah A. Lechok
*Attorney, Agent, or Firm*—Rodgers & Rodgers

[57] ABSTRACT

For use as a component of a display stand, a shelf of the gravity feed type includes a support frame on which a plurality of tracks of different widths are arranged in side by side relation, each track including at least one support plate and a pair of plastic elements secured atop the support plate, each plastic element having a base strip and a side strip secured to one side edge of the base strip and arranged in perpendicular relation thereto to form a structure of L-shaped cross section and the plastic strips being arranged with the edges of the base strips which are opposite from the side strips disposed adjacent each other to form an article track.

11 Claims, 3 Drawing Sheets

GRAVITY FEED SHELF

TECHNICAL FIELD

This invention relates to gravity feed shelves which include a plurality of low friction tracks arranged in side by side relation to each other and which are of different widths

BACKGROUND ART

U. S. Pat. No. 4,314,648 issued Feb. 9, 1982 and assigned to the assignee of this invention discloses a gravity feed shelf in which low friction tracks are utilized and which are formed by an extrusion process and which are homogenous in nature with low friction material impregnated therein.

U. S. Pat. No. 4,470,943 issued Sept. 11, 1984 and owned by the assignee of this invention discloses and claims a process for forming a low friction plastic track which is homogenous from a mixture of high impact polystyrene and organo polysiloxane fluid such as dimethyl, diethyl and phenylmethyl siloxane and related copolymers.

U. S. Pat. No. 4,496,037 issued Jan. 29, 1985 and owned by the assignee of this invention discloses an L-shaped track component having a frangible notch along the length of the track whereby the width of the track may be reduced by severing a portion of the track base along the frangible notch.

U. S. Pat. No. 4,565,725 issued Jan. 21, 1986 and owned by the assignee of this invention discloses a composite plastic track and method of making by a coextrusion process.

SUMMARY OF THE INVENTION

According to this invention in one form, a gravity feed shelf is provided which includes a support frame, a plurality of tracks of different widths arranged in side by side relation on the frame, each track including at least one support plate and a pair of plastic elements each of which includes a base strip secured atop a support plate and a side strip secured to one side edge of the base strip and in perpendicular relation thereto to form a structure of L-shaped cross section, the plastic strips being arranged with the edges of the base strips which are remote from the side strips disposed adjacent each other either in close juxtaposition or in spaced relation to each other.

BEST MODE OF CARRYING OUT THE INVENTION

Figure 1:
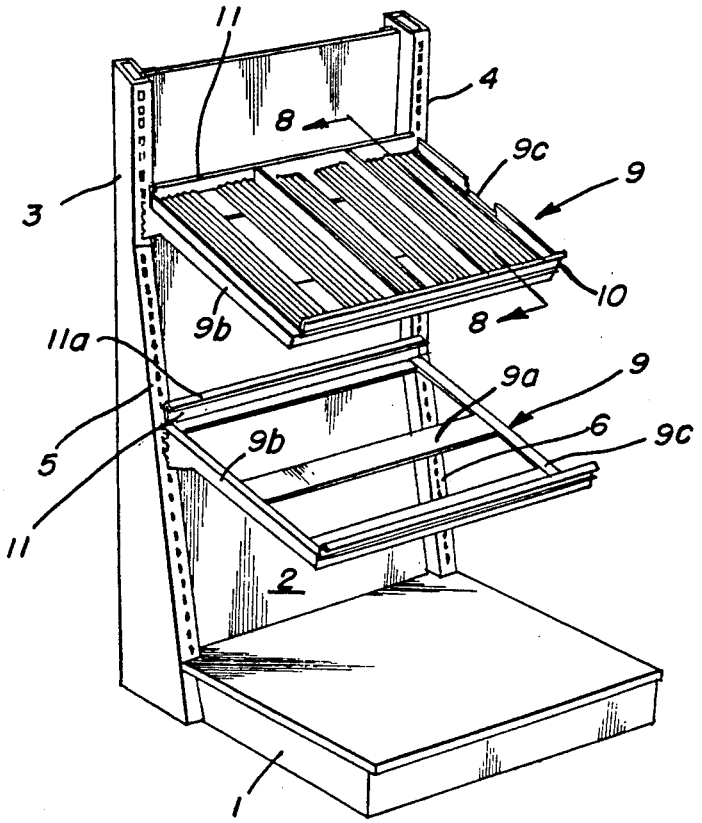
FIG. 1 is a perspective view of a display stand having gravity feed shelves utilizing plastic tracks formed according to this invention.

FIG. 1 shows a display stand having a base 1 and a back 2 extending upwardly from the base. Back panel 2 is supported by upright shelf support members 3 and 4 having sloping surfaces 5 and 6 respectively. Shelves 8 and 9 are disjointably secured at their rear portions to uprights 3 and 4 by disjointable securing means well known in the art.

Figure 3:
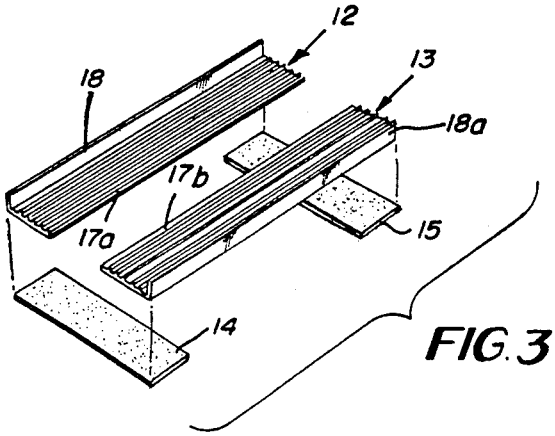
FIG. 3 is an exploded perspective view of a pair of spaced apart support plates above which a pair of plastic elements are disposed.
Figure 4:
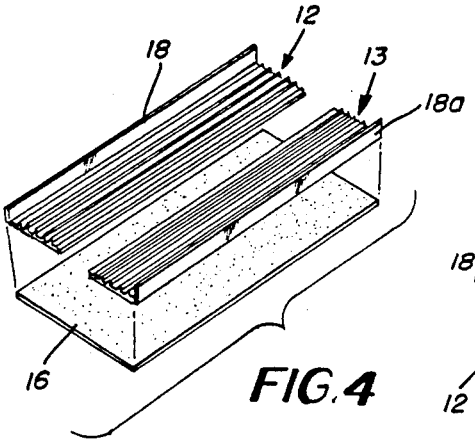
FIG. 4 is a view similar to FIG. 3 but instead of a pair of support plates a single rectangular support plate is shown.
Figure 5:
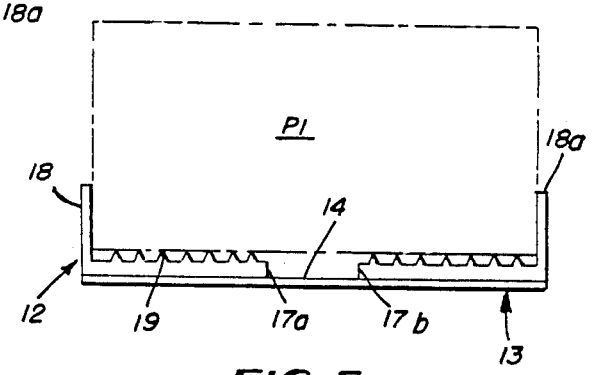
FIG. 5 is an end view of the structure shown in FIG. 3 when assembled and showing in phantom lines a package disposed thereon.
Figure 6:
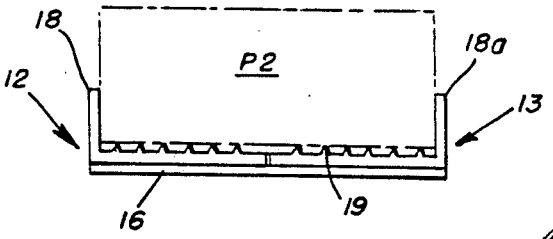
FIG. 6 is a view similar to FIG. 5 but which is formed from the structure of FIG. 4 and which shows in phantom lines a package of smaller dimensions than that shown in FIG. 5.
Figure 7:
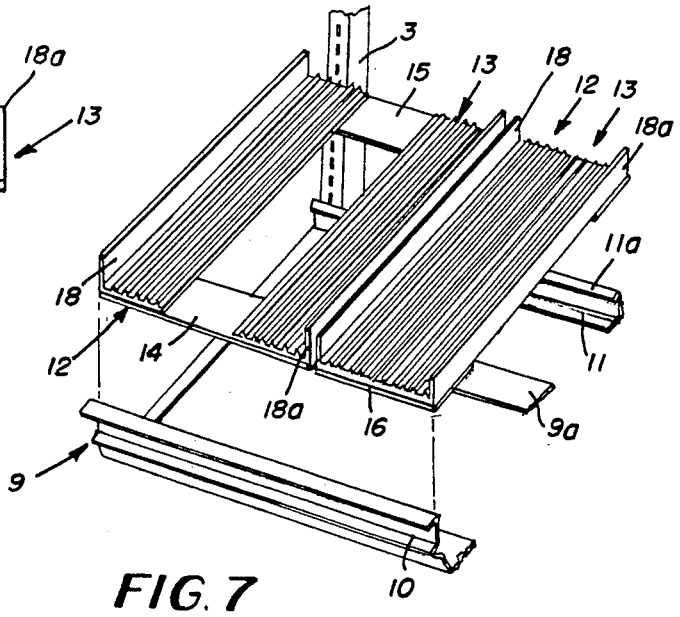
FIG. 7 is an exploded perspective view showing the tracks of FIGS. 5 and 6 disposed in side by side relation.
Figure 8:
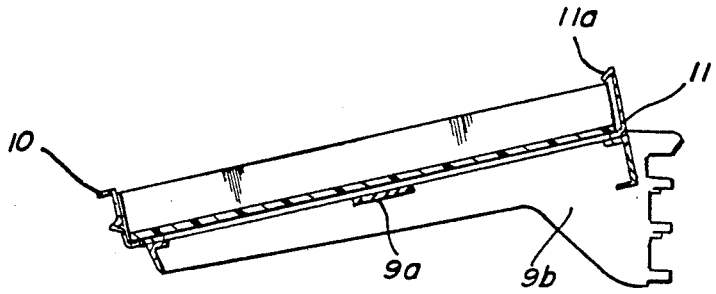
FIG. 8 is a section taken along the line 8—8 in FIG. 1.
Figure 9:
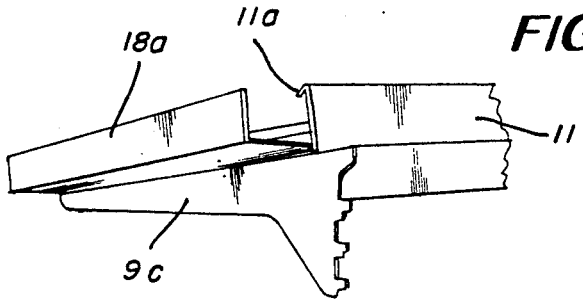
FIG. 9 is a fragmentary view of a corner of a shelf which shows that the shelf frame has no side walls and which allows a track to extend over the side of a shelf frame.
Figure 10:
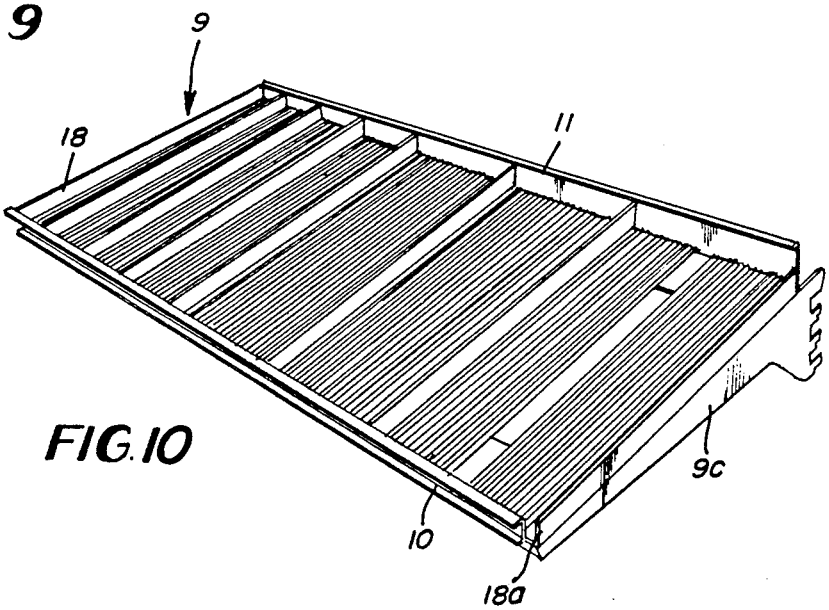
FIG. 10 is a perspective view of a shelf having a plurality of tracks of different widths.
Figure 11:
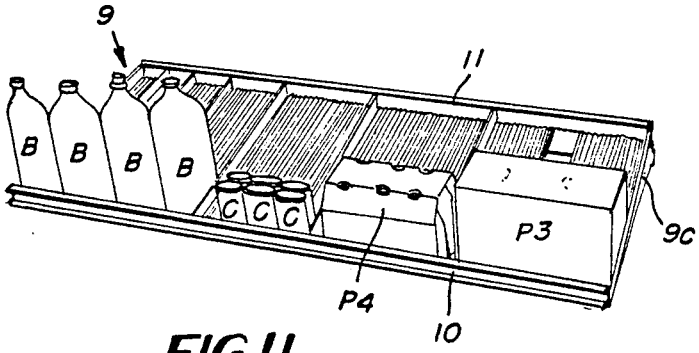
FIG. 11 is a view similar to FIG. 10 but which shows a variety of products of different types and sizes displayed together.

According to a main aspect of this invention, shelf tracks are provided which are of different widths and are supported at their ends by front rail 10 and back rail 11 and which thereby accommodate products of varying sizes on a single shelf. As is shown in FIGS. 2–6, each track includes a pair of plastic elements 12 and 13 secured atop a pair of support plates 14 and 15 as shown in FIGS. 3 and 5 or as indicated in FIGS. 4 and 6 the tracks 12 and 13 may be secured atop a single support plate 16 to provide a display of packages such as Pl. Ordinarily the single support plate 16 is rectangular in configuration and whose length is equal to the length of the plastic elements and whose width is specific to the transverse dimension of the package such as P2 for which such track is to be used.

Figure 2:
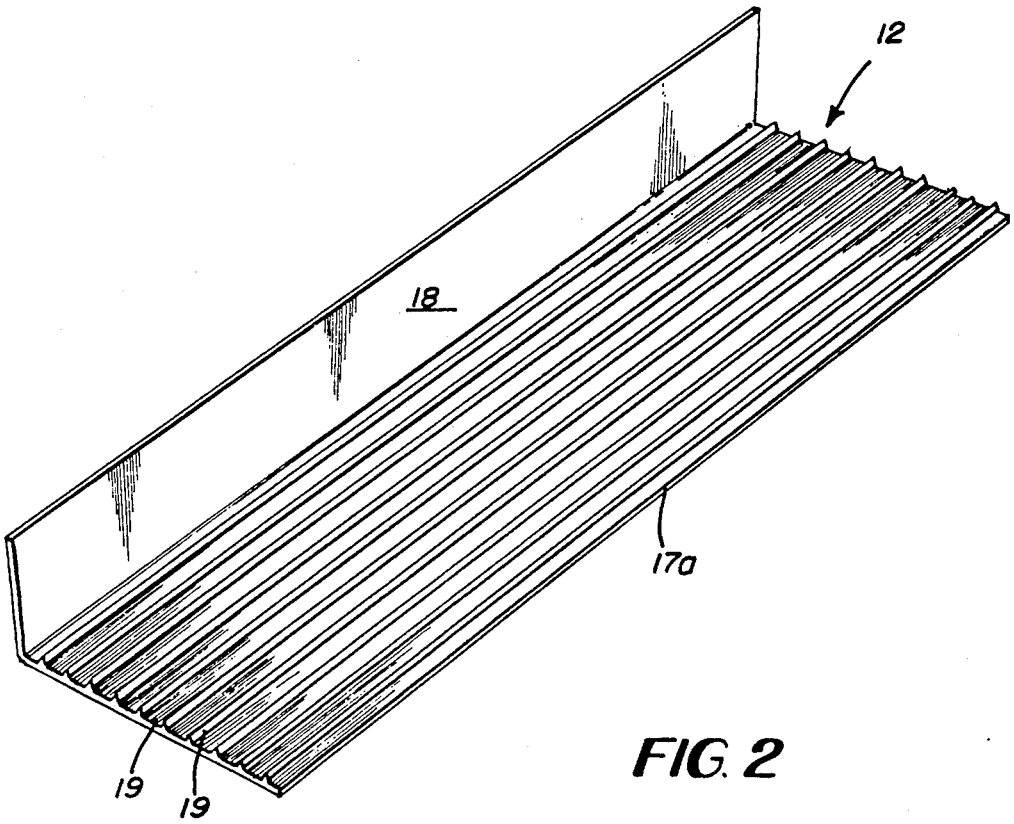
FIG. 2 is an enlarged perspective view of a plastic element of L-shaped cross section and which is used in forming tracks of varying widths according to a feature of this invention.

As best shown in FIG. 2, each plastic element such as 12 includes a base strip such as 17 and a side strip such as 18. A plurality of upraised ribs 19 are formed along the upper surface of base strip 17 as is indicated in FIGS. 2, 5 and 6. The plastic elements 12 and 13 are well adapted to accommodate articles of different sizes by simply varying the space between adjacent edge portions such as 17*a* and 17*b* of plastic elements 12 and 13 respectively.

As shown in FIGS. 7, 8, 9, 10 and 11, the shelves such as 9 do not include side walls. Instead the side strips such as 18 and 18*a* serve as side walls. Thus two or more display stands may be placed side by side with the side strips such as 18 and 18*a* of the stand in close contact with corresponding side strips of an adjacent stand to form a continuous attractive display of a variety of items. Holding means is provided in that the front of each track rests on cross bar 10 and the rear is captured on bar 11 under the flange 11*a*.

It is apparent that the plastic tracks may be integrally molded or the component L-shaped structures and the support plate or plates may be formed separately and then assembled by means of suitable adhesive represented by stippling in FIGS. 3 and 4.

From the above description, it is obvious that by this invention a gravity feed shelf for a display stand is provided which incorporates side by side tracks of different widths so that an attractive display may be formed showing different items of different sizes or similar items of different sizes thus to afford an easy choice for a purchaser so that a desired item may readily be identified and removed from the shelf.

I claim:

1. A gravity feed shelf comprising a tilted support frame, a plurality of tracks of different widths arranged in side by side relation and fixedly secured to said frame so that articles on said tracks move downwardly and forwardly in opposition to the friction between the articles and tracks due solely to the force of gravity, each track including at least one support plate and a pair of plastic elements, each of said plastic elements including a base strip secured atop said support plate and a side strip secured to one side edge of said base strip and in perpendicular relation thereto to form a structure of L-shaped cross section, said plastic elements being arranged with the opposite edge of each of said base strips which is remote from said one side edge thereof being disposed adjacent each other to form an article track, said side strips comprising the sides of each of said tracks, the outer side strip of the outer tracks of the shelf defining the outer side extremities of the shelf, and holding means including a transverse flange overlying the rear of said tracks.

2. A gravity feed shelf according to claim 1 wherein said opposite edges of said base strips are disposed in close juxtaposition to each other.

3. A gravity feed shelf according to claim 1 wherein said opposite edges of said base strips are spaced apart.

4. A gravity feed shelf according to claim 1 wherein said base strips are secured atop a plurality of support plates in fixed relation thereto.

5. A gravity feed shelf according to claim 1 wherein said support plate is of rectangular configuration and wherein the length of said support plate corresponds to the length of said plastic elements and the width of said support plate corresponds to the space between said one side edges of said base strips.

6. A gravity feed shelf according to claim 4 wherein one of said support plates is disposed at the front of the shelf and another of said support plates is disposed at the back of the shelf.

7. A gravity feed shelf according to claim 4 wherein a plurality of low friction parallel ribs are formed along the top surface of said base strips.

8. A gravity feed shelf according to claim 1 wherein each of said tracks is formed by a molding process.

9. A gravity feed shelf according to claim 1 wherein each track is formed of molded plastic elements secured atop at least one support plate by suitable adhesive and the width of each track is specific to a particular package size.

10. A gravity feed shelf according to claim 1 wherein said frame comprises a removable guard along its front edge and holding means along the front and rear of said frame for receiving the front and rear ends of said tracks.

11. A gravity feed shelf according to claim 1 wherein the outer side strip of the outer tracks of the shelf define the outer extremities of the shelf and are arranged in close disposition to the outer side strip of the track of an adjacent shelf.

* * * * *